US007009583B2

(12) United States Patent
Holtslag et al.

(10) Patent No.: US 7,009,583 B2
(45) Date of Patent: Mar. 7, 2006

(54) DISPLAY PANEL WITH SUSTAIN ELECTRODES

(75) Inventors: Antonius Hendricus Maria Holtslag, Eindhoven (NL); Harm Tolner, Eindhoven (NL); Petrus Antonius Johannes Maria Verscharen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 521 days.

(21) Appl. No.: 09/951,863

(22) Filed: Sep. 13, 2001

(65) Prior Publication Data

US 2002/0067320 A1 Jun. 6, 2002

(30) Foreign Application Priority Data

Sep. 18, 2000 (EP) ..... 00203235

(51) Int. Cl.
*G09G 3/28* (2006.01)

(52) U.S. Cl. ..... 345/60; 345/66; 345/67; 315/169.4

(58) Field of Classification Search ..... 345/60, 345/61–63, 55, 66, 68, 74.1, 76; 315/167–168, 315/169.1, 169.4; 313/484, 491, 514, 517, 313/520

See application file for complete search history.

(56) References Cited

U.S. PATENT DOCUMENTS

| | | | | |
|---|---|---|---|---|
| 5,661,500 | A | 8/1997 | Shinoda et al. | 345/60 |
| 6,097,357 | A * | 8/2000 | Shinoda et al. | 345/63 |
| 6,320,326 | B1 * | 11/2001 | Shino et al. | 315/169.4 |
| 6,335,712 | B1 * | 1/2002 | Kim | 345/60 |
| 6,373,452 | B1 * | 4/2002 | Ishii et al. | 345/67 |
| 6,404,412 | B1 * | 6/2002 | Van Asma | 345/72 |

FOREIGN PATENT DOCUMENTS

| | | |
|---|---|---|
| EP | 0837442 A1 | 4/1998 |
| EP | 0874349 A1 | 10/1998 |

* cited by examiner

*Primary Examiner*—Ricardo Osorio
*Assistant Examiner*—Mansour M. Said

(57) ABSTRACT

A flat-panel display apparatus having plasma discharge cells forming pixels arranged in a matrix of M row and N columns, wherein N is larger than M. The flat display panel has sustain electrodes and scan electrodes arranged in one direction and data electrodes in a second direction perpendicular to the first direction. A data driver circuit is coupled to the data electrodes for supplying data signals to the discharge cells in response to video information, wherein the data electrodes are arranged to constitute the M rows, the sustain and scan electrodes are arranged to constitute the N columns and the data driver circuit is adapted to supply data signals to a column of selected pixels.

19 Claims, 8 Drawing Sheets

DISPLAY PANEL WITH SUSTAIN ELECTRODES

Figure 1:
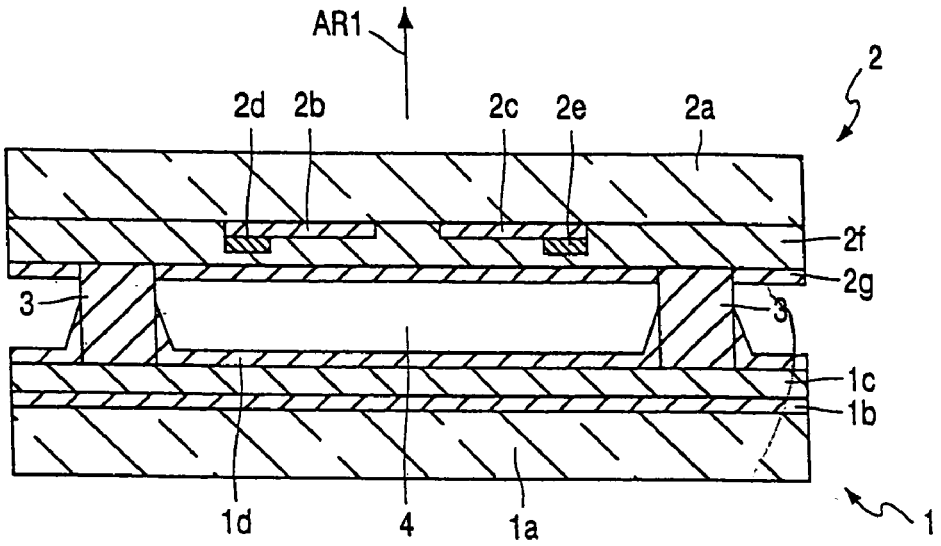
FIG. 1 PRIOR ART

The invention relates to a flat-panel display apparatus having plasma discharge cells with sustain electrodes and scan electrodes and a drive circuit. The invention is particularly applicable to AC plasma display panels used for personal computers, television sets, etc.

A plasma display panel is known from U.S. Pat. No. 5,661,500. The known plasma display panel comprises first and second substrates parallel to and facing each other for defining a space filled with a discharge gas, pairs of lines of display electrodes formed on the first substrate facing the second substrate, each pair of lines of display electrodes being parallel to each other and constituting an electrode pair for surface discharge, a dielectric layer on the display electrodes and the first substrate, lines of address electrodes formed on the second substrate facing the first substrate and extending in a direction intersecting the lines of display electrodes, three phosphor layers which are different from each other in respective lumiscent colors and are formed on the second substrate in successive order of said three luminscent colors along the extending lines of displays and barriers standing on the second substrate to divide and separate said discharge space into cells corresponding to respective phosphor layers, wherein the adjacent three phosphor layers of said three luminescent colors and a pair of lines of display electrodes define one image element of a full color display. In a plasma display panel, each row of the matrix is thus defined by two line electrodes, a scan electrode and a sustain electrode. A cell is defined by a crossing of one row electrode and one data electrode.

To show a picture on such a display, a sequence of three driving modes is applied for each subframe:

An erase mode, in which old data in the cells is 'erased', so that the next (sub)frame can be loaded.

A scanning mode, in which the data of the (sub)frame to be shown is written into the cells.

A sustain mode, in which light (and thus the picture) is generated. All cells are sustained at the same time.

In order to select one of the scan electrodes and a corresponding sustain electrode, the sustain electrode may be connected to a common ground and the scan electrodes may be connected to a scan electrode drive circuit. Assuming that a plasma display panel has M rows of pixels, 3M scan electrode driver circuits are necessary to supply the drive pulses to the scan electrodes of the panel. Such a panel has 3M connections for supplying the drive pulses to the scan electrodes. Furthermore, the data electrodes are connected to N data drivers. The data drivers supply the data pulses to the data electrodes. Since a pixel comprises three cells for the respective three colors, a plasma display panel for displaying, for example, a wide-VGA picture comprises 2556 (3×852) data drivers and 480 scan electrode drivers.

It is a drawback of the known display device that a relatively high number of connections is required to supply the data signals to the columns and the drive pulses to the scan electrodes.

It is an object of the invention to provide a display device in which the total number of connections of the panel is decreased. This object is achieved by the display device according to the invention which is defined in the present claim 1. The invention is based on the recognition that, in practice, plasma display panels comprise more pixels per row than the total number of rows. The total number of connections can be reduced by transposing the display in such a way that the sustain and scan electrodes now constitute the columns and the former data electrodes now constitute the rows. The scan and sustain electrodes now select a column of cells instead of a row of cells. If the video information to be displayed comprises frames of lines, a video transposing circuit is necessary to transpose the video information. If a computer video card generates the video information, the computer video card has to be arranged to transpose the video information.

A further advantage is obtained when the area of the scan electrode driver integrated circuit is smaller than three times the area of the data driver integrated circuit. In this case, a reduction can be obtained of the total area of integrated circuits of both the data driver and the scan driver. The reduction is illustrated in the following example.

If, for example, the known plasma display panel has 480 rows and 2556 columns, the total number of data drivers is 2556 and the total number of scan electrode driver circuits is 480. A corresponding plasma display panel according to the invention has 1440 (3×480) data driver circuits and 852 scan electrode driver circuits. In this way, the number of data drivers and also the total number of connections of the display is reduced. If, for example, a scan electrode driver circuit can be realized in 0.75 $mm^2$ per connection and a data driver circuit can be realized in 0.45 $mm^2$ per connection, the total area of the data driver circuits of the known plasma display panel is $3\times852\times0.45=1150$ $mm^2$ and the total area of the scan electrode driver circuit is $480\times0.75$ $mm^2=360$ $mm^2$. For the corresponding plasma display panel with transposed scan, the total area of the data driver circuits is $3\times480\times0.45=648$ $mm^2$ and the total area of the scan electrode driver circuits driving the scan electrodes is $852\times0.75$ $mm^2=639$ $mm^2$. The total reduction in the area of the driver circuits is now 223 $mm^2$, which leads to a reduction of the manufacturing costs of the plasma display panel.

Further advantageous embodiments are defined in the dependent claims.

A particular embodiment of a plasma display panel according to the invention is defined in claim 2. This embodiment allows display of different luminance levels for the different pixels of an image. In this plasma display panel, a field may comprise a number of subfields. Each subfield comprises an erase period, an address period for priming the cells that should emit light during the sustain period and a sustain period during which actual light is radiated. The sustain period of each subfield is given, for example, a weight of 32,16,8,4,2 or 1 corresponding to a 6-bit signal. This subfield coding is known per se from EP 0 890 941.

A further embodiment of a plasma display panel according to the invention is defined in claim 3. This embodiment allows display of 8 bit video information. Normally, the addressing of a cell requires, for example 3 $\mu$s. In a known plasma display panel displaying a wide-VGA picture, the addressing time Ta thus requires $480\times3$ $\mu s=1.5$ ms per subfield. In a corresponding plasma display panel according to the invention, the addressing time is $852\times3$ $\mu s=2.5$ ms per subfield. The display of 8 bit video information then requires $8\times2.5=20$ ms which is incompatible with existing VGA standards. Therefore, in this embodiment, sets of adjacent columns are formed and the same luminance value for some of the least significant subfields is displayed. By addressing more columns simultaneously, the addressing time is reduced, thereby enabling the generation of 256 luminance values. The value displayed may be the average value of the original individual values of the pixels. This addressing method is described in the non-prepublished PHNL000025.

A further embodiment of a plasma display panel according to the invention is defined in claim 4. In this embodiment, the sustain and scan electrodes are multiplexed and the number of connections to the plasma display panel can be further reduced. In a plasma display panel with K sustain electrodes and K scan electrodes, the number of connections can be reduced from 2K to $2\sqrt{K}$.

A further embodiment of a plasma display panel according to the invention is defined in claim 5. In this embodiment, the peak currents are spread in time because the sustain plasma discharge for at least one group of pairs of electrodes is shifted in phase in relation to at least one other group of the groups of pairs, such that the respective sustain plasma discharges are shifted in time. The peak plasma currents (and the discharge currents) are spread across two (or more) discharge moments and reduced (by a factor of n if there are n discharge moments for an equal number of groups). This may be used to lower dissipation in the sustain electrode drivers or to reduce the number of components (and thereby costs). The dissipation is equal to $I^2*R*t/T$, with I being the current, R the resistance (of components in the sustain circuit and t/T the fraction of time the current flows. It can be seen that with n peak currents having 1/n intensity, the dissipation is decreased by a factor of 1/n.

Preferably, the m groups of sustain electrodes and the n groups of scan electrodes form n*m groups of pairs of electrodes. This allows a more efficient distribution of peak currents across the groups.

Preferably, the currents in adjacent pairs of electrodes are in counterphase during discharge. When the discharge is in counterphase, the currents in adjacent cells and pairs of electrodes flow in opposite directions. By placing columns with an opposed current direction near each other, electromagnetic radiation fields of these columns cancel each other at some distance from the device.

These and other aspects of the invention are apparent from and will be elucidated with reference to the embodiments described hereinafter.

Figure 2:
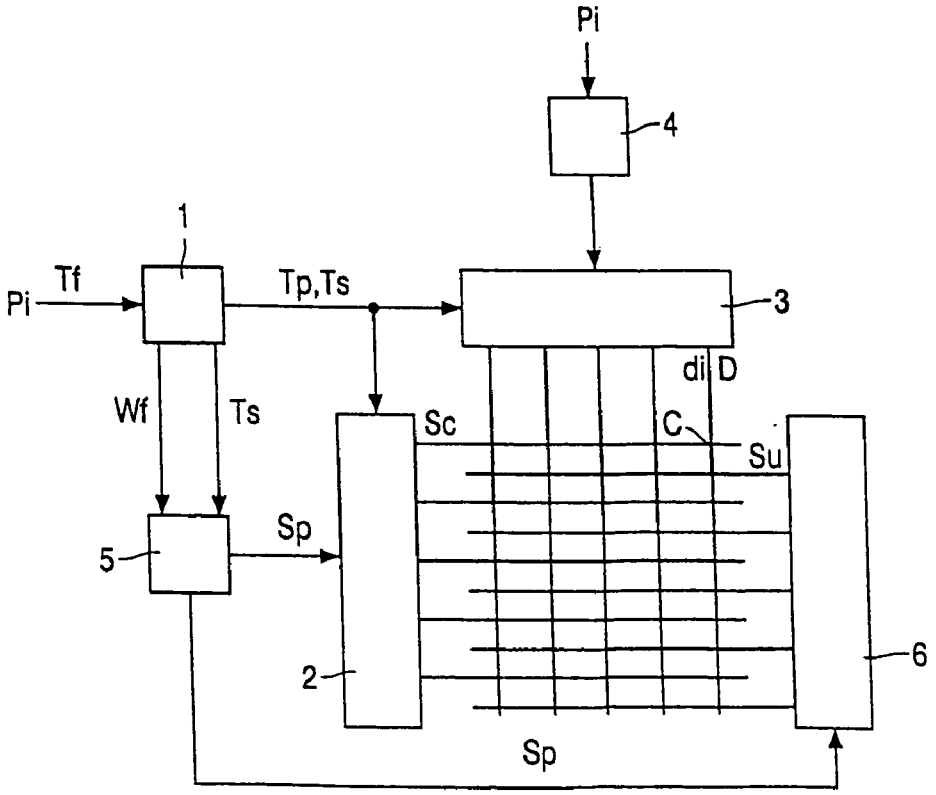
FIG. 2 PRIOR ART
Figure 3:
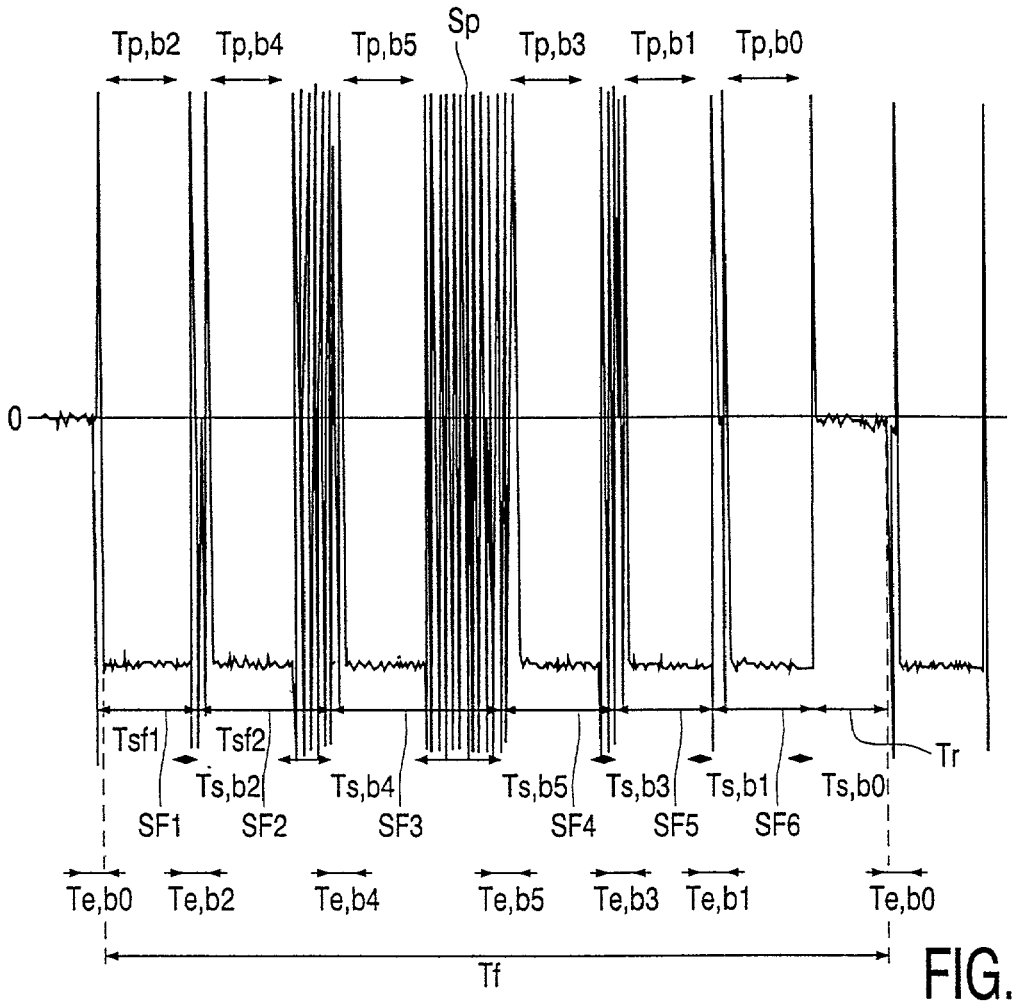
Figure 4:
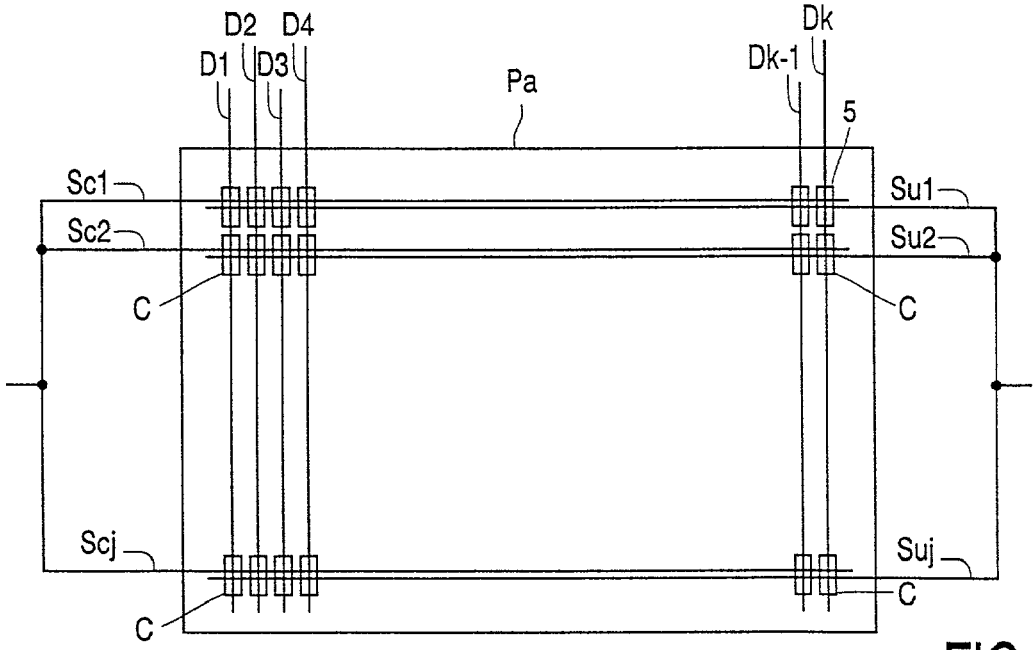
Figure 5:
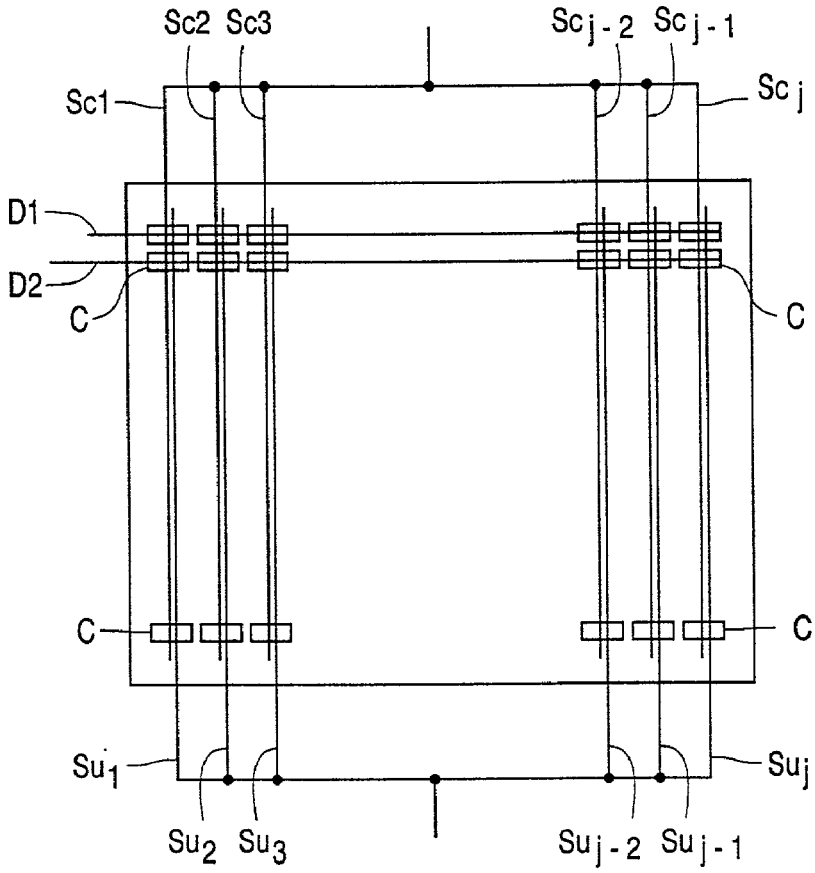
Figure 6:
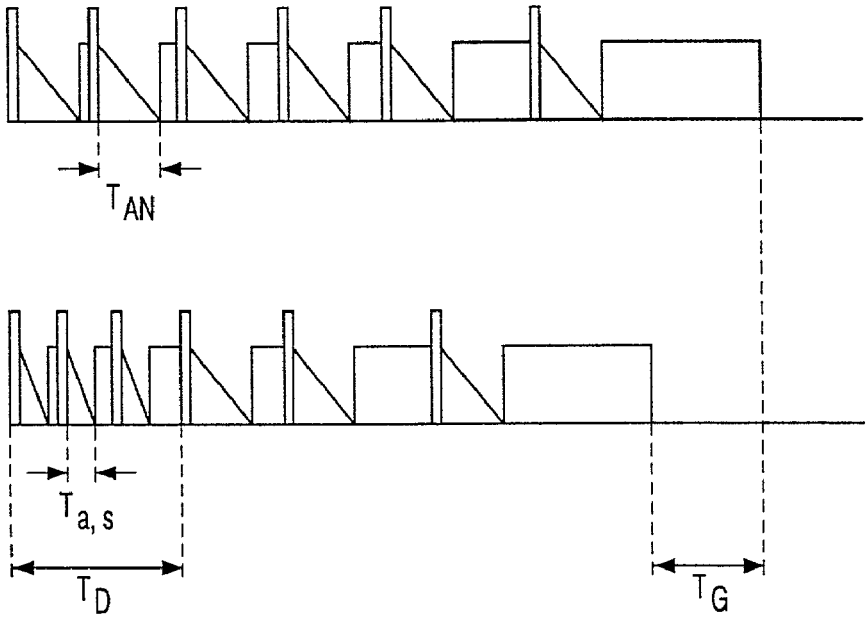
Figure 7:
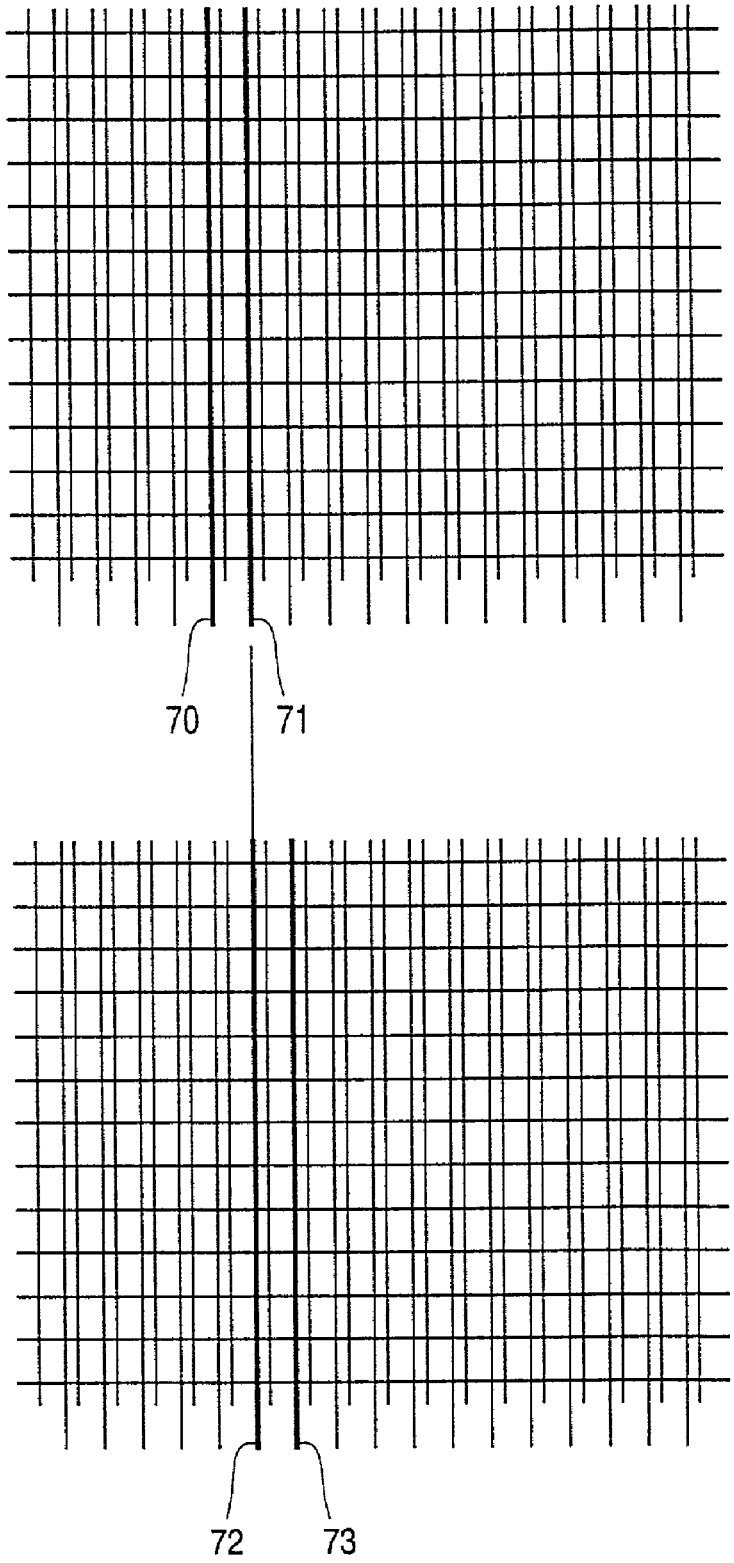
Figure 8:
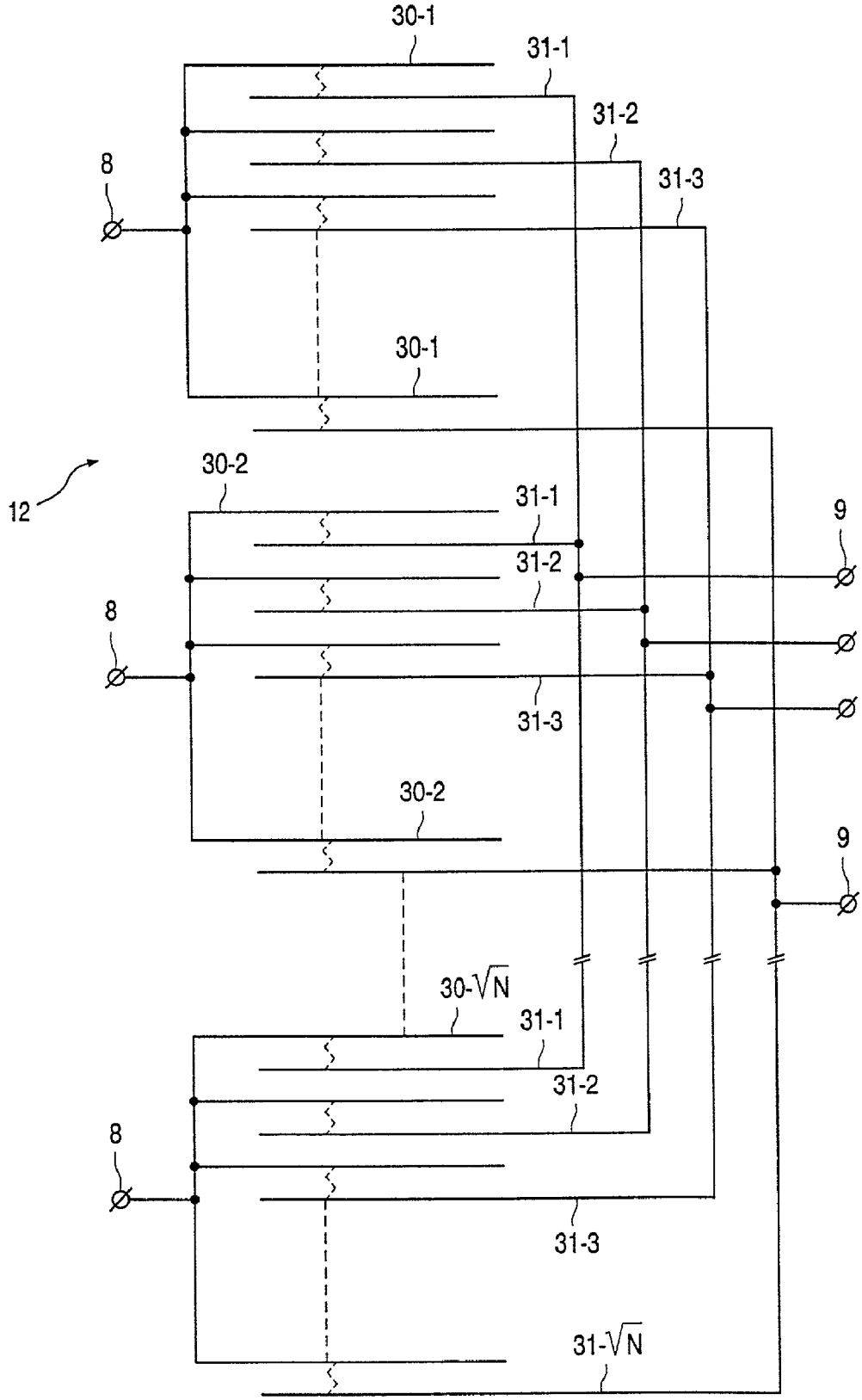
Figure 9:
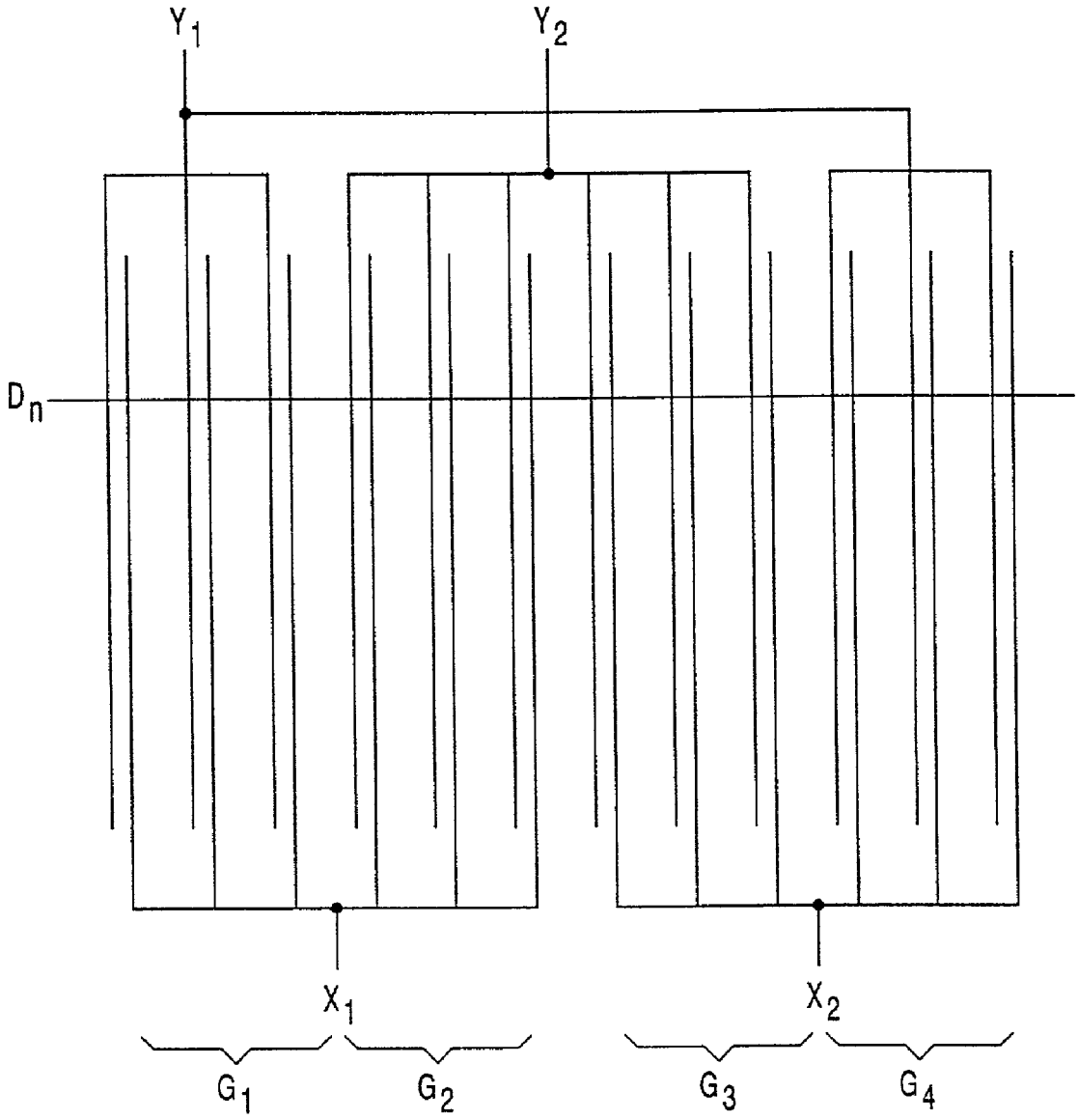
Figure 10:
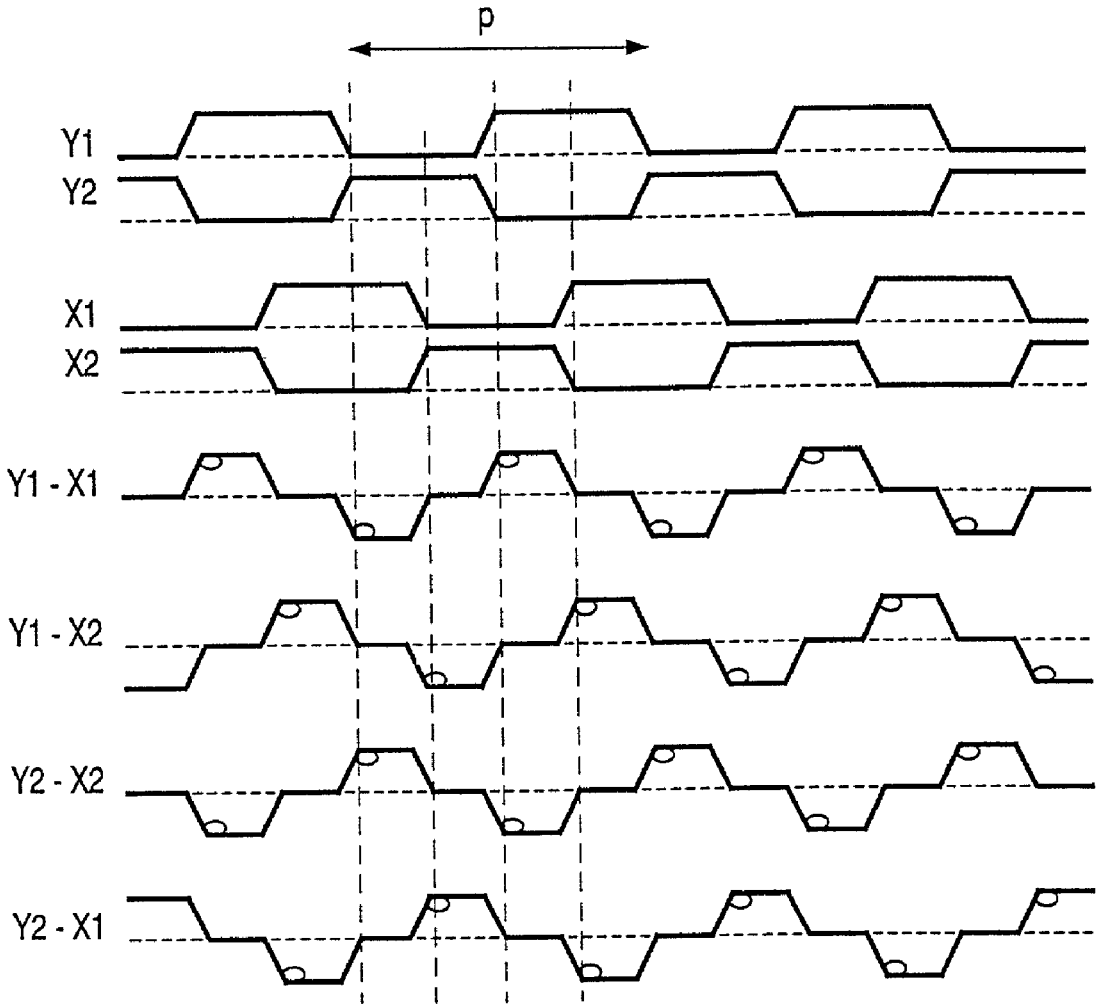
Figure 11:
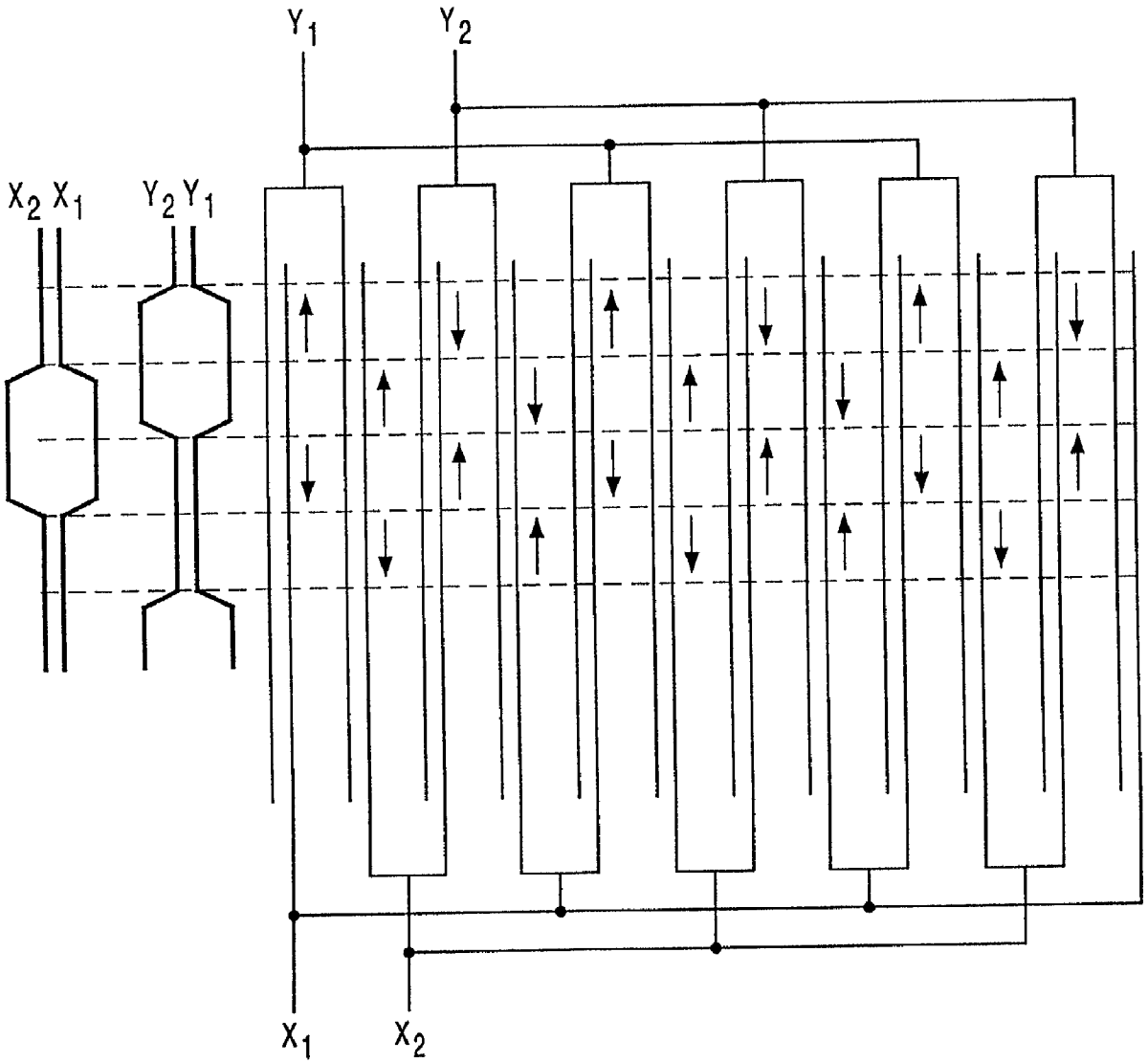

In the drawings:

FIG. 1 is a cross-sectional view of a cell of a plasma panel display,

FIG. 2 schematically illustrates a circuit for driving a plasma display panel of a surface discharge type in a subfield mode as known from the prior art, FIG. 3 illustrates voltage waveforms between scan and sustain electrodes of the known plasma display panel, FIG. 4 shows a layout of cells in a known plasma display panel, FIG. 5 illustrates the layout of pixels C in a plasma display panel Pb with a transposed scan arrangement, FIG. 6 shows a subfield distribution, and the time gain obtained by double column addressing of the four least significant subfields, FIG. 7 shows a method wherein double column and double frame addressing is used, FIG. 8 shows a schematic circuit of sustain and scan electrode connections in multiple groups, FIG. 9 illustrates a plasma display panel in which the sustain electrodes are subdivided into n groups and the scan electrodes are subdivided into m groups, FIG. 10 illustrates the sustain pulses on the sustain and scan electrodes and between them in the device illustrated in FIG. 9 and FIG. 11 illustrates a plasma display panel in which the currents in adjacent pairs of scan and sustain electrodes are in counterphase during discharge.

The priorart cell shown in FIGS. 1 and 2 produces an image in the following steps.

FIG. 1 illustrates the structure of a cell. The cell has a back structure 1 and a front structure 2, and a partition 3 which spaces the back structure 1 from the front structure 2. Discharge gas 4 such as helium, neon, xenon or a gaseous mixture thereof fills the space between the back structure 1 and the front structure 2. The discharge gas generates ultraviolet light during discharge. The back structure 1 includes a transparent glass plate 1*a*, and a data electrode 1*b* is formed on the transparent glass plate 1*a*. The data electrode 1*b* is covered with a dielectric layer 1*c*, and a phosphor layer 1*d* is laminated on the dielectric layer 1*c*. The ultraviolet light is radiated onto the phosphor layer 1*d*, and the phosphor layer 1*d* converts the ultraviolet light into visible light. The visible light is indicated by arrow AR1. The front structure 2 includes a transparent glass plate 2*a*, and a scan electrode 2*b* and a sustain electrode 2*c* are formed on the transparent glass plate 2*a*. The scan electrode 2*b* and the sustain electrode 2*c* extend in the perpendicular direction to the data electrode 1*b*. Trace electrodes 2*d*/2*e* may be laminated on the scan electrode 2*b* and the sustain electrode 2*c*, respectively, and are expected to reduce the resistance against a scanning signal and a sustain signal. These electrodes 2*b*, 2*c*, 2*d* and 2*e* are covered with a dielectric layer 2*f*, and the dielectric layer 2*f* may be covered by a protective layer 2*g*. The protective layer 2*g* is formed, for example, of magnesium oxide and protects the dielectric layer 2*f* from the discharge. An initial potential larger than the discharge threshold is applied between a scan electrode 2*b* and a data electrode 1*b*. Discharge takes place between them. Positive charge and negative charge are attracted towards the dielectric layers 2*f*/1*c* on the scan electrode 2*b* and the data electrode 1*b* and are accumulated thereon as wall charges. The wall charges produce potential barriers and gradually decrease the effective potential. Therefore, the discharge is stopped after some time. Thereafter, a sustain pulse is applied between the scan electrodes 2*b* and the sustain electrodes 2*c*, which is identical in polarity with the wall potential. Consequently, the wall potential is superimposed on the sustain pulse. Because of the superimposition, the effective potential exceeds the discharge threshold and a discharge is initiated. Thus, while the sustain pulse is being applied between the scan electrodes 2*b* and the sustain electrodes 2*c*, the sustain discharge is initiated and continued. This is the memory function of the device. This process occurs in all cells at the same time.

When an erase pulse is applied between the scan electrodes 2*b* and the sustain electrodes 2*c*, the wall potential is cancelled, and the sustain discharge is stopped. The erase pulse has a wide pulse width and a low amplitude or narrow width.

FIG. 2 schematically illustrates a circuit for driving a plasma display panel of a surface-discharge type in a subfield mode as known from the prior art. Two glass panels (not shown) are arranged opposite to each other. Data electrodes D are arranged on one of the glass panels. Pairs of scan electrodes Sc and sustain electrodes Su are arranged on the other glass panel. The scan electrodes Sc are aligned with the sustain electrodes Su, and the pairs of scan and sustain electrodes Sc, Su are perpendicular with respect to the data electrodes D. Display elements (for example, plasma cells C) are formed at the crossings points of the data electrodes and the pairs of scan and sustain electrodes Sc, Su. A timing generator 1 receives display information Pi to be displayed on the plasma display panel. The timing generator 1 divides a field period Tf of the display information Pi into a predetermined number of consecutive subfield periods Tsf. A subfield period Tsf comprises an address period or prime period Tp and a display or sustain period Ts. During an address period Tp, a scan driver 2 supplies pulses to the scan electrodes Sc, and a data driver 3 supplies data di to the data electrodes D to write the data di into the display elements C associated with the selected scan electrode Sc. In this way, the display elements C associated with the selected scan electrode Sc are preconditioned. A sustain driver 6 drives the sustain electrodes Su. During an address period Tp, the sustain driver 6 supplies a fixed potential. During a display period Ts, a sustain pulse generator 5 generates sustain pulses Sp which are supplied to the display elements C via the scan driver 2 and the sustain driver 6. The display elements, which are preconditioned during the address period Tp to produce light during the display period Ts, produce an amount of light depending on a number or a frequency of sustain pulses Sp. It is also possible to supply the sustain pulses Sp to either the scan driver 2 or the sustain driver 6. It is also possible to supply the sustain pulses Sp to the data driver 3 or both to the scan driver 2 or the sustain driver 6 and the data driver 3.

The timing generator 1 further assigns a fixed order of weight factors Wf to the subfield periods Sf in every field period Tf. The sustain generator 5 is coupled to the timing generator to supply a number or a frequency of sustain pulses Sp in conformance with the weight factors Wf, such that an amount of light generated by the preconditioned cell C corresponds to the weight factor Wf. A subfield data generator 4 performs an operation on the display information Pi, such that the data di is in conformance with the weight factors Wf.

When regarding a complete panel, the sustain electrodes Sc in the prior art are interconnected for all rows of the plasma display panel. The scan electrodes Sc are connected to row ICs and scanned during the addressing or priming phase. The column electrodes Co are operated by column Ics and the plasma cells C are operated in three modes:

1. Erase mode. Before each subfield is primed, all plasma cells C are erased at the same time. This is done by first driving the plasma cells C into a conducting state and then removing all charge built up in the cells C.
2. Prime mode. Plasma cells C are conditioned in such a way that they will be in an on or off-state during the sustain mode. Since a plasma cell C can only be fully on or off, several prime phases are required to write all bits of luminance value. Plasma cells C are selected on a row-at-a-time basis and the voltage levels on the columns Co will determine the on/off condition of the cells. If a luminance value is represented in 6 bits, then also 6 subfields are defined within a field.
3. Sustain mode. An alternating voltage is applied to scan and sustain electrodes Sc, Su of all rows at the same time. The column voltage is mainly at a high voltage potential. The plasma cells or pixels C primed to be in the on state, will light up. The weight of an individual luminance bit will determine the number of light pulses during sustain.

FIG. 3 shows voltage waveforms between scan electrodes Sc and sustain electrodes Su of a known plasma display panel. Since there are three modes, the corresponding time sequence is indicated as Te,bx (erase mode for bit-x subfield), Tp,bx (prime mode for bit-x subfield) and Ts,bx (sustain mode for bit-x subfield).

FIG. 4 further illustrates the layout of cells C in a known plasma display panel Pa. The cells are identical in structure with the cell shown in FIG. 1 and form a display area. The cells are arranged in j rows and k columns, and a small box stands for each cell in FIG. 4. Scan electrodes (Sci) and sustain electrodes (Sui) extend in the direction of the rows, and the scan electrodes are paired with the respective sustain electrodes. The pairs of scan/sustain electrodes are associated with the respective rows of cells. Data electrodes (Di) extend in the direction of columns, and are associated with the respective columns of cells.

FIG. 5 illustrates the layout of cells C in a plasma display panel Pb with the transposed scan arrangement. The cells are still identical in structure with the cell shown in FIG. 1. The cells are arranged in m rows and n columns and a small box stands for each cell in FIG. 5. Scan electrodes (Sci) and sustain electrodes (Sui) extend in the direction of the columns and the scan electrodes are paired with the respective sustain electrodes. In this embodiment, the pairs of scan/sustain electrodes are associated with the respective columns of cells. The data electrodes extend in the direction of the rows and are associated with the respective rows of cells. In order to display an image on the plasma display panel, each column is addressed individually. The data driver has to be adapted to supply the data signals, corresponding to the red, green and blue cells of a row, one by one to the data electrode. Assuming that a wide-VGA picture comprises 3×852 cells per row and 480 rows, the number of data drivers is 3×480 and the number of scan electrode drivers is 852. In this way, the number of connections of the display is reduced.

Furthermore, if the area required for a scan electrode driver integrated circuit is less than three times the area required for a data driver integrated circuit, a saving in total required area of the integrated circuits is obtained with the transposed scan arrangement of the plasma display panel. If, for example, a scan electrode driver circuit can be realized in 0.75 $mm^2$ per connection and a data driver circuit can be realized in 0.45 $mm^2$ per connection, the total area of the data driver circuits is $3\times852\times0.45\ mm^2=1150\ mm^2$ for the conventional plasma display panel and the total area for the scan electrode driver circuit is $480\times0.75\ mm^2=360\ mm^2$. For the corresponding plasma display panel with the transposed scan arrangement, the total area for the data driver circuits becomes $3\times480\times0.45\ mm^2=648\ mm^2$ and the total area for the scan electrode driver circuits driving the scan electrodes becomes $852\times0.75\ mm^2=639\ mm^2$. The total area becomes 1510 $mm^2$ and the total reduction in the area of the driver circuits that can be obtained is 223 $mm^2$, which leads to a reduction of the manufacturing costs of the plasma display panel.

A timing diagram that can be used in plasma display panel with the transposed scan is shown in the upper half of FIG. 6, where the addressing time is the same for each subfield. The addressing time Ta,n can be reduced by application of a Line Doubling method, applied to some of the least significant subfields. This is shown in the lower half of FIG. 6. Addressing two adjacent columns simultaneously with the same data reduces the addressing time Ta,s for the least significant subfields and causes a time gain Tg which can be used to increase the number of subfields to improve the number of grey levels of the display.

An improvement of the image quality can obtained by grouping the columns of the respective even and odd fields in different sets of lines. For example, the columns are grouped in line pairs 70,71 for odd fields and other pairs of lines 72,73, shifted by one line, for even fields as shown in FIG. 7. A further improvement of image quality can be obtained by copying the average value of the original luminance value of the set of lines to the other line of the pairs in the set instead of one line of the original lines. Also grouping of the columns differently in successive fields of frames improves the image quality and reduces the addressing time.

In order to reduce the number of connections of the plasma display panel and the number of scan drivers, the sustain electrodes can be interconnected in a number of first groups and the scan electrodes are interconnected in a number of second groups, such that each first group includes no more than one scan electrode of each second group.

FIG. 8 shows an example of an arrangement of sustain electrodes 30-1, . . . , 30-$\sqrt{N}$ and scan electrode 31-1, . . . , 31-$\sqrt{N}$ connections in plural groups. The number of pulse drivers coupled to the connections 8,9 to the plasma display panel decreases by taking both the sustain electrodes 30-1, . . . , 30-$\sqrt{N}$ and the scan electrodes 31-1, . . . , 31-$\sqrt{N}$ together in groups, such that each sustain electrode group 30-1, . . . , 30-$\sqrt{N}$ includes no more than one of the electrodes of each scan electrode group 31-1, . . . , 31-$\sqrt{N}$ and, similarly, each scan electrode group 31-1, . . . , 31-$\sqrt{N}$ includes no more than one electrode of each sustain electrode group 30-1, . . . , 30-$\sqrt{N}$. Adjacent sustain electrodes and scan electrode pairs are located in one plasma channel 20, and the plasma channels whose electrodes form any one of the first group thus include no more than one electrode of any one of the second group. The sustain and scan electrodes may be interconnected on the plasma display panel to reduce the number of connections of the plasma display panel. Assuming a plasma display panel with N columns of pixels, both the sustain electrodes 30-1, . . . , 30-$\sqrt{N}$ and scan electrodes 31, . . ., 31-$\sqrt{N}$ are taken together in groups of $\sqrt{N}$ lines, with one connection 8,9 per group. This leads to $2\sqrt{N}$ connections 8,9 (instead of N+1) to the output conductors.

In order to improve the electromagnetic compatibility (EMC) in an embodiment of the plasma display panel, the sustain electrodes are subdivided into n groups X1 and X2 (i.e. n=2) and the scan electrodes are subdivided into m groups Y1 and Y2 (i.e. m=2), as is shown in FIG. 9. Four (n*m) groups of pairs of electrodes are thus formed: the first group G1 of Y1 and X1, the second group G2 of Y2 and X1, the third group G3 of Y2 and X2 and the fourth group G4 of Y1 and X2. FIG. 10 illustrates the sustain pulses on the groups of scan electrodes (Y1,Y2), the groups of sustain electrodes (X1, X2), and the pulses between the electrodes $X_i$ and $Y_i$. It can be seen that all pulses on the different groups of electrodes are shifted in phase with respect to each other as well as are all pulses on the groups of pairs. The sustain pulses on the groups of sustain electrodes (X1–X2) are in counterphase, as they are for the groups of scan electrodes (Y1–Y2). The phase difference between the pulses on the scan and-sustain electrodes is $\pi/2$ or a multiple thereof (see, for instance, the groups Y1-X1 and Y1-X2 for which the pulses differ one quarter of a period, i.e. $\pi/2$, the groups Y1-X1 and Y2-X2 differ half a period etc.). The instants at which plasma discharge takes place (four per period) are also indicated by an asterisk. The plasma discharges take place between electrodes at the two distinct times. Consequently, the peak currents (whether they are plasma discharge currents, capacitive currents, and whether they are to sink or source charge) are spread across two instants. This may be used to lower dissipation in the sustain circuit or to reduce the number of components (and thereby costs). The dissipation is equal to $I^2*R*t/T$, with I being the current, R the resistance (of components in the sustain circuit) and t/T the fraction of time the current flows. It can be seen that, with n peak currents having 1/n intensity, the dissipation is decreased by a factor of 1/n.

The discharge moments are then equally distributed in time, reducing the dissipation and peak currents. They are also equally distributed across the groups of scan and sustain electrodes.

FIG. 11 shows a plasma display panel in which the currents in adjacent pairs of scan and sustain electrodes are in counterphase during discharge. In this example, the currents in adjacent pairs of scan and sustain electrodes are in counterphase during discharge. When the discharge is in counterphase, the currents flow in opposite directions. The large arrows indicate plasma discharge current. When viewed along a horizontal line, it can be seen that the current in adjacent columns flows in opposite directions. The electromagnetic fields associated with the currents are therefore also in opposite directions and cancel each other at some distance from and in the device. This reduces interference of such fields with other circuits. By placing columns with an opposed current direction near each other, electromagnetic radiation fields of these columns thus cancel each other at some distance from and in the device. Voltages on the electrodes Y1, Y2, X1, X2 are shown in the left-hand part of FIG. 11.

What is claimed is:

1. A flat-panel display apparatus, comprising:

plasma discharge cells forming pixels arranged in a matrix of M rows and N columns, wherein N is larger than M, sustain electrodes and scan electrodes extending in a first direction and data electrodes extending in a second direction transverse to the first direction, crossings between the data electrode on the one side and sustain and scan electrodes on the other side corresponding to the plasma discharge cells, a drive circuit coupled to the sustain and scan electrodes for supplying driving pulses to the sustain and scan electrodes, and a data drive circuit coupled to the data electrodes for supplying data signals to the discharge cells in response to video information, wherein the data electrodes are arranged to constitute the M rows and the sustain and scan electrodes are arranged to constitute the N columns, and the data driver circuit is adapted to supply data signals to a column of selected pixels.

2. A flat-panel display apparatus as claimed in claim 1, further comprising addressing means arranged to address the columns in sets of adjacent columns corresponding to successive image frames or fields, said image frames or fields having original luminance value data being coded in subfields comprising a group of most significant subfields and a group of least significant subfields, a common luminance value data being supplied to columns of a set of said sets of columns.

3. A flat-panel display apparatus as claimed in claim 2, wherein the addressing means are arranged to perform the addressing in sets of adjacent columns differently for a) successive frames or fields and/or b) for different regions of the display and/or c) for different subfields.

4. A flat-panel display apparatus as claimed in claim 1, wherein the sustain electrodes are interconnected in a number of first groups and the scan electrodes are interconnected in a number of second groups, such that each first group includes no more than one scan electrode of each second group.

5. A flat-panel display apparatus as claimed in claim 1, wherein the sustain electrodes comprise m groups of sustain electrodes and the scan electrodes comprise n groups of scan electrodes forming groups of pairs of electrodes, and wherein, in operation, the drive circuit applies sustain pulses to the respective groups of pairs of electrodes which are shifted in phase, such that plasma discharges for at least one group of pairs take place at a different time than for at least one other group of the groups of pairs.

6. A flat-panel display apparatus as claimed in claim 5, wherein the phase shifts between pulses on the group of scan electrodes are substantially an equal amount of $2\pi/m$ and/or the phase shifts between pulses on the group of sustain electrodes are substantially an equal amount of $2\pi/n$.

7. A flat-panel display apparatus, comprising:

a first substrate;

a second substrate;

a plurality of electrode pairs extending lengthwise in a first direction, each said electrode pair comprising a sustain electrode and a scan electrode spaced apart from each other;

partitions between the first and second substrates at locations which, when viewed from above the first substrate, are disposed between adjacent ones of the electrode pairs, each said partition extending lengthwise in the first direction;

a plurality of data electrodes formed on the second substrate and extending lengthwise in a second direction transverse to the first direction;

a plurality of plasma discharge cells forming pixels arranged in a matrix of M rows and N columns, each said plasma discharge cell corresponding to a crossing between one of the data electrodes and one of said electrode pairs comprising a sustain electrode and a scan electrode;

a drive circuit coupled to the sustain and scan electrodes for supplying driving pulses to the sustain and scan electrodes; and a data drive circuit coupled to the data electrodes for supplying data signals to the discharge cells in response to video information, wherein the data electrodes are arranged to constitute the M rows, and the electrode pairs comprising the sustain and scan electrodes are arranged to constitute the N columns, wherein the data driver circuit is adapted to supply data signals to a column of selected pixels, and wherein N>M.

8. The flat panel display apparatus of claim 7, further comprising addressing means arranged to address the columns in sets of adjacent columns corresponding to successive image frames or fields, said image frames or fields having original luminance value data being coded in subfields comprising a group of most significant subfields and a group of least significant subfields, a common luminance value data being supplied to columns of a set of said sets of columns.

9. The flat panel display apparatus of claim 8, wherein the addressing means are arranged to perform the addressing in sets of adjacent columns differently for a) successive frames or fields and/or b) for different regions of the display and/or c) for different subfields.

10. The flat panel display apparatus of claim 7, wherein the sustain electrodes are interconnected in a number of first groups and the scan electrodes are interconnected in a number of second groups, such that each first group includes no more than one scan electrode of each second group.

11. The flat panel display apparatus of claim 7, wherein the sustain electrodes comprise m groups of sustain electrodes and the scan electrodes comprise n groups of scan electrodes forming groups of pairs of electrodes, and wherein, in operation, the drive circuit applies sustain pulses to the respective groups of pairs of electrodes which are shifted in phase, such that plasma discharges for at least one group of pairs take place at a different time than for at least one other group of the groups of pairs.

12. The flat panel display apparatus of claim 11, wherein the phase shifts between pulses on the group of scan electrodes are substantially an equal amount of $2\pi/m$ and/or the phase shifts between pulses on the group of sustain electrodes are substantially an equal amount of $2\pi/n$.

13. A flat-panel display apparatus, comprising:

a first substrate;

a second substrate;

N sustain electrodes and N scan electrodes spaced apart from each other and extending lengthwise in a first direction, said N sustain electrodes and N scan electrodes forming N electrode pairs;

3M data electrodes formed on the second substrate and extending lengthwise in a second direction transverse to the first direction;

a plurality plasma discharge cells arranged in a matrix of 3M rows and N columns, each said plasma discharge cell corresponding to a crossing between one of said 3M data electrodes and one of said N electrode pairs;

a drive circuit coupled to the sustain and scan electrodes for supplying driving pulses to the sustain and scan electrodes; and a data drive circuit coupled to the data electrodes for supplying data signals to the discharge cells in response to video information, wherein the data electrodes are arranged to constitute the 3M rows, and the electrode pairs comprising the sustain and scan electrodes are arranged to constitute the N columns, wherein the data driver circuit is adapted to supply data signals to a column of selected pixels, and wherein N>M.

14. The flat panel display apparatus of claim 13, further comprising addressing means arranged to address the columns in sets of adjacent columns corresponding to successive image frames or fields, said image frames or fields having original luminance value data being coded in subfields comprising a group of most significant subfields and a group of least significant subfields, a common luminance value data being supplied to columns of a set of said sets of columns.

15. The flat panel display apparatus of claim 14, wherein the addressing means are arranged to perform the addressing in sets of adjacent columns differently for a) successive frames or fields and/or b) for different regions of the display and/or c) for different subfields.

16. The flat panel display apparatus of claim 13, wherein the sustain electrodes are interconnected in a number of first groups and the scan electrodes are interconnected in a number of second groups, such that each first group includes no more than one scan electrode of each second group.

17. The flat panel display apparatus of claim 13, wherein the sustain electrodes comprise m groups of sustain electrodes and the scan electrodes comprise n groups of scan electrodes forming groups of pairs of electrodes, and wherein, in operation, the drive circuit applies sustain pulses to the respective groups of pairs of electrodes which are shifted in phase, such that plasma discharges for at least one group of pairs take place at a different time than for at least one other group of the groups of pairs.

18. The flat panel display apparatus of claim 17, wherein the phase shifts between pulses on the group of scan electrodes are substantially an equal amount of $2\pi/m$ and/or the phase shifts between pulses on the group of sustain electrodes are substantially an equal amount of $2\pi/n$.

19. The flat panel display apparatus of claim 13, wherein $N>3M$.

* * * * *